United States Patent [19]

Freund

[11] 4,218,016

[45] Aug. 19, 1980

[54] LANCE TUBE CONSTRUCTION

[75] Inventor: Melvin A. Freund, Lancaster, Ohio

[73] Assignee: The Babcock & Wilcox Company, New Orleans, La.

[21] Appl. No.: 928,172

[22] Filed: Jul. 26, 1978

[51] Int. Cl.[2] ..... B05B 3/18

[52] U.S. Cl. ..... 239/186; 239/553; 239/DIG. 13

[58] Field of Search ..... 239/DIG. 13, 186, 132.3, 239/132.5, 553, 184, 187

[56] References Cited

U.S. PATENT DOCUMENTS

| | | | |
|---|---|---|---|
| Re. 28,769 | 4/1976 | Rymarchyk | 239/132.3 X |
| 860,523 | 7/1907 | Canules | 239/DIG. 13 |
| 3,068,507 | 12/1962 | Evans | 15/317 |
| 3,784,101 | 1/1974 | Frempter | 239/553 X |

*Primary Examiner*—Richard A. Schacher

*Attorney, Agent, or Firm*—Harness, Dickey & Pierce

[57] ABSTRACT

A lance tube for use in long retracting cleaning devices of the soot blower type which in operation discharge jets of liquid against the fouled surfaces of heat exchangers such as the slag-coated surfaces of boiler tubes and the like incorporates a light weight hollow filler tube mounted in the lance tube by a helical spacer rib.

6 Claims, 2 Drawing Figures

LANCE TUBE CONSTRUCTION

BACKGROUND OF THE INVENTION

Soot blowers employed for cleaning slag from the heat exchanging surfaces of large modern fossil-fueled public utility boilers are in some installations required to be projectable for long distances into boiler spaces. Under severe slagging conditions, it has become increasingly common due to improvements in water cleaning techniques to employ water as the blowing medium, while the boiler is on the line, rather than steam and/or air. A slurry consisting of water with other ingredients has also been employed. In order to be self supporting, the lance tube must be of substantial diameter. The weight of the water in the lance tube and the resultant increased tendency of the tube to sag when projected have limited the length of travel which it has been possible to employ with water blowers as distinguished from steam and air blowers. The object of the present invention is to provide an improved water blower and lance tube construction, particularly for boiler cleaning apparatus of the indicated nature, which is more resistant to undesirable sagging of the lance tube when projected, and which incorporates means which promotes more efficient cooling of the lance tube. Other objects and advantages will become apparent upon consideration of the present disclosure in its entirety.

BRIEF DESCRIPTION OF THE FIGURES OF DRAWING

FIG. 1 is a somewhat diagramatic side elevational view of a long retracting water blower incorporating the principles of the present invention, mid portions being partly broken away, and FIG. 2 is a view principally in longitudinal diametric section, but with portions shown in side elevation, of a lance tube constructed in accordance with the present invention.

DETAILED DESCRIPTION OF PREFERRED FORM OF THE INVENTION

Figure 1:
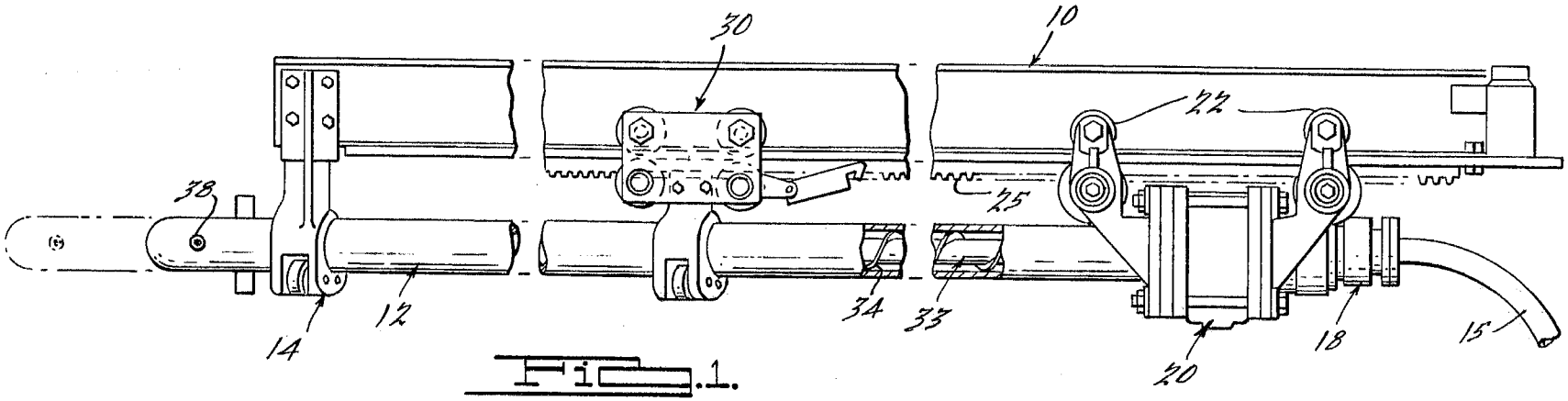

Reference character 10 designates generally the supporting I-beam of a long retracting water blower. The major components of the blower may correspond to those of a conventional soot blower of the well known "IK" type such as is disclosed in U.S. Pat. No. 2,668,978 to L. S. DeMart issued Feb. 16, 1954, although it will readily be recognized that the invention is equally adaptable to variant constructions and blowers of different lengths. An IK blower of a still longer travel type is disclosed in U.S. Pat. No. 3,439,376 to John E. Nelson et al, issued Apr. 22, 1969.

In all such blowers, the blowing medium is delivered to a lance tube, designated 12 in the present application, which is projectable into and retractable from the interior of the furnace, boiler space or the like which contains the surfaces to be cleaned. The lance tube is normally also rotated or oscillated about its longitudinal axis while moving into and out of the served zone. As the parts are shown in FIG. 1, the boiler space or other area containing the surfaces to be cleaned (not shown) would be at the left, and the lance tube, when projected, is introduced through a ported wall box opening (not shown). The lance tube is supported at the forward end of the beam 10 by means of a front roller support assembly 14. The beam is attached by suitable structural means (not shown) to the structure of the boiler setting, as is well known in the art, so that the beam projects perpendicularly from the exterior of the wall of the boiler or other fluid heating structure.

In conventional IK blowers, designed to employ a gaseous blowing medium such as steam and/or air, the blowing medium is delivered to the lance tube through a stationary feed tube upon the open end of which the lance tube is slidably overfitted. The feed tube projects into the lance tube far enough so that the parts always overlap, and the blowing medium is delivered to the feed tube under the control of a blow valve, as is also well known in the art.

It will be appreciated that the gaseous type of blowing medium does not add appreciable weight to the lance tube, so that the problem of preventing undue sag of the projected lance tube is not materially affected by the weight of the blowing medium. Where water or a water slurry is to be projected, however, the weight of the liquid blowing medium is substantial, and the sagging problem is aggravated. A method of utilizing water for effective cleaning of a steaming boiler with minimum thermal shock is disclosed in U.S. Pat. No. 3,782,336 granted Jan. 1, 1974 to John E. Nelson.

In adapting the blower to a liquid blowing medium, the telescopically interfitted stationary feed tube is eliminated, and the liquid blowing medium is delivered to the lance tube 12 by means of a flexible hose 15 connected thereto by means of a rotary coupling 18 supported, with the lance tube, on the carriage assembly 20. The carriage assembly may also be of one of the conventional constructions disclosed in prior patents such as those referred hereinabove, containing means for driving the lance tube both axially and angularly. In the illustrated construction the carriage is supported on and rolls along the beam through the agency of trolley support rollers 22. A motor (not shown) on the carriage drives the same along the beam through the agency of suitable pinion means (not shown) meshing with a rack 25 secured to the underside of the beam. An intermediate support assembly generally designated 30, is also provided to inhibit sagging of the retracted lance tube. The construction of this feature is disclosed in the aforementioned U.S. Pat. No. 2,668,978.

Figure 2:
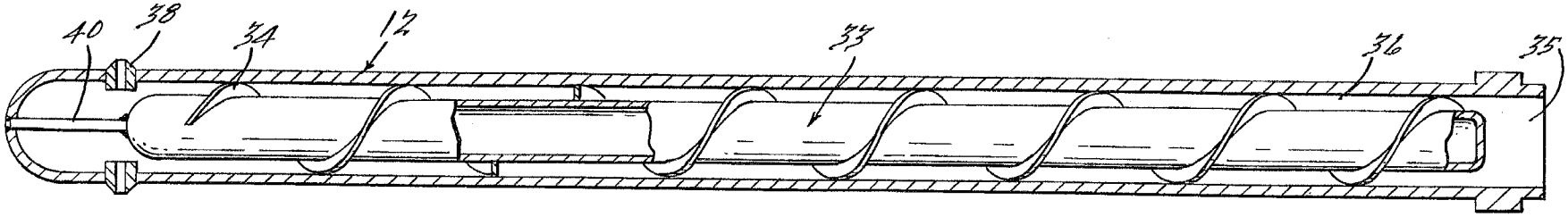

A hollow filler tube generally designated 33, having an outside diameter somewhat less than the internal diameter of the lance tube 12, is fitted into the lance tube and extends substantially the full length thereof, as shown in FIG. 2. The filler tube may be constructed of a stiff heat resistant plastic or a metal of relatively thin gauge. It is closed at both ends to define a sealed enclosure, thereby eliminating liquid from the area occupied by the filler tube, which has a total weight substantially less than that of the liquid which it displaces. The filler tube is also provided with radially projecting portions serving to space the filler tube from the wall of and concentrically within the lance tube. In the preferred construction illustrated, spacing is effected by a helical fin 34 secured to the filler tube and which has its outer edge fitting closely against but unattached to the inner wall of the lance tube. The rib or fin 34 defines a water channel and further stiffens the assembly. A plurality rather than a single fin may of course be employed. Water entering the open rear end 35 of the lance tube is conducted in a helical path by the fin through the relatively narrow annular space 36 between the two tubes, from which it is discharged through the nozzles 38 at the forward end. Being maintained in close association with the wall of the lance tube, the water is most effective in cooling the lance. As shown in FIG. 2, the forward end of the filler tube is spaced from the forward end of the lance tube by a spacer rod 40 which is attached to both tubes in an axial position, but no other attachment is provided between the filler and lance tubes, and differential expansion between the two tubes is therefore free to occur.

The liquid feed hose 15 is provided with sufficient slack so that its lance tube end may simply travel with the carriage and lance tube.

In order to permit the use of a thinner walled filler tube than would otherwise be possible, with consequent minimization of weight and sag, the filler tube is filled with an inert gas such as nitrogen under pressure.

This Detailed Description of Preferred Forms of the Invention, and the accompanying drawings, have been furnished in compliance with the statutory requirement to set forth the best mode contemplated by the inventor of carrying out the invention. The prior portions consisting of the Abstract of the Disclosure and the Background of the Invention are furnished without prejudice in an effort to comply with administrative requirements of the Patent Office.

What is claimed is:

1. A lance tube for cleaning apparatus for boilers and the like, which apparatus is designed to project an aqueous liquid, comprising an elongated tube having an inlet end and a discharge end, discharge orifice means appurtenant to the discharge end thereof and through which tube liquid is adapted to be conducted for discharge through such orifice means, characterized by a filler tube extending longitudinally within the lance tube and comprising a sealed hollow enclosure, the filler tube being of lesser diameter than the lance tube and having a total weight less than the weight of water displaceable thereby, means being provided to space the filler tube from the internal wall of the lance tube, whereby liquid may flow between the lance tube and filler tube for discharge through such orifice means.

2. A lance tube as defined in claim 1 wherein the filler tube extends a substantial proportion of the full length of the lance tube.

3. A lance tube as defined in claim 1, including helically disposed spacing means carried by the filler tube and substantially bridging the radial distance between the filler tube and the internal wall of the lance tube, whereby liquid moving longitudinally between the tubes is conducted in a helical path by such spacing means.

4. A lance tube as defined in claim 1, including means attaching the filler tube at one end thereof only to the lance tube, whereby differential expansion is permitted between the filler tube and lance tube.

5. A lance tube as defined in claim 1 wherein the filler tube is formed of light weight material.

6. A lance tube as defined in claim 1 wherein the filler tube is formed of material of relatively thin gauge, the interior of the filler tube being pressurized.

* * * * *